US005407126A

United States Patent [19]

Coultas et al.

[11] Patent Number: 5,407,126

[45] Date of Patent: * Apr. 18, 1995

[54] SINGLE-DOOR SECURITY MAILBOX

[76] Inventors: Raymond D. Coultas; Victoria S. Coultas, both of 33815 Andy Way, Winchester, Calif. 92596

[ * ] Notice: The portion of the term of this patent subsequent to Feb. 18, 2011 has been disclaimed.

[21] Appl. No.: 986,686

[22] Filed: Dec. 8, 1992

[51] Int. Cl.[6] ..... B65D 91/00

[52] U.S. Cl. ..... 232/17; 70/161; 292/78; 292/341.17

[58] Field of Search ..... 232/17, 23, 31, 35, 232/41 D; 70/160, 161, 162; 292/78, 116, 213, 341.17

[56] References Cited

U.S. PATENT DOCUMENTS

| | | | |
|---|---|---|---|
| 236,910 | 1/1881 | Phillips | 292/270 |
| 272,360 | 2/1883 | Warren | 292/116 |
| 4,390,198 | 6/1983 | Selinko | 292/DIG. 38 |
| 4,447,005 | 5/1984 | Kelly et al. | 232/35 |
| 4,726,512 | 2/1988 | White | 232/17 |
| 5,082,169 | 1/1992 | Aurness et al. | 232/17 |

*Primary Examiner*—Michael J. Milano

[57] ABSTRACT

A single-door security rural mailbox having a front closure that can be accessed by the rural mail carrier and the owner of the mailbox from the same opening. The mailbox has a key operated locking mechanism for locking the closure. The owner of the mailbox locks and sets the closure in a set position allowing the mail carrier to open the closure once. The mail carrier then closes the closure with sufficient force so that the locking mechanism passes the set position and engages in a locked position. Thereafter, the closure can only be unlocked by the owner with a key who then sets the lock and closure for the next mail delivery where again the mail carrier can open and then shut the closure.

1 Claim, 8 Drawing Sheets

SINGLE-DOOR SECURITY MAILBOX

BACKGROUND—FIELD OF INVENTION

This invention relates generally to the field of depository receptacles, and more specifically to rural mailboxes of the single-door type.

BACKGROUND—DESCRIPTION OF PRIOR ART

Depository receptacles are commonly characterized by a single access opening which is readily accessible to authorized persons, as for example the rural mail carrier. This easy accessibility feature, while being a distinct advantage to mail carriers, does pose certain disadvantages for the owner of the receptacle. This means that unauthorized persons have the same accessibility as authorized persons. Thus, articles such as packages, checks, credit cards and mail, placed in receptacle by mail carrier are subject to theft or vandalism.

Since it is not functional for mail delivery purposes to employ a rural mailbox which requires unlocking by the mail carrier, heretofore persons on a rural or residential route with conventional mailboxes have suffered the inconvenience associated with an insecure depository for their mail. One mailbox device which provides a solution to this problem is disclosed in U.S. Pat. No. 3,758,027 to Morgan. Thus, this reference discloses a mailbox having upper and lower compartments interconnected by a trap door which defines a bottom for the upper compartment when in closed condition. The lower compartment is provided with a lock device so that only authorized persons have access thereto. This device, however, because of the nature of the mechanics involved and the necessity for two compartments, cannot be manufactured economically, and the trap door design inherently places severe restrictions on the amount of usable space.

Another mailbox disclosed in U.S. Pat. No. 4,382,540 to Kelly has double doors in which the back door locks and allows the front door to be opened and then shut one time thus locking itself. The disadvantages to this is that you cannot drive up to your mailbox to remove your mail with out getting out of your car and because of the complex mechanical nature of this device it cannot be manufactured as economically as a conventional mailbox.

The following references disclose various types of locking mechanisms for depositories and receptacles:

| | |
|---|---|
| U.S. Pat. No. 975,455 | Prevost |
| U.S. Pat. No. 1,038,53 | Hodgkinson |
| U.S. Pat. No. 1,110,779 | Hartman |
| U.S. Pat. No. 1,219,360 | Storms |
| U.S. Pat. No. 1,305,722 | Kees |
| U.S. Pat. No. 1,458,200 | Sloan |
| U.S. Pat. No. 1,478,552 | Chapman |
| Great Britain Pat. No. 422,682 | Jordan |

All of the above mentioned references disclose receptacles with oppositely faced outer and inner doors with various means of locking only the outer door. No locking means is disclosed for the inner door therefore all these receptacles would not provide a secure depository for rural mailbox use. U.S. Pat. No. 3,675,845 to Scheerer and U.S. Pat. No. 3,891,139 to Redling disclose single door mailboxes having magnetically operated automatic signal mechanisms which are operated by sequential opening and closing of the mailbox door.

These two devices, however, do not provide the security locking features of the present invention.

Presently most single door mailboxes that can be locked incorporates the use of a depository slot usually in the front of the mailbox and then the owner of the mailbox must maintain a locked box (such as a padlock) at all times to keep their mail safe. The disadvantage of using a slot is that it is normally of a dimension that restricts the size of material that can be placed in the compartment so that some packages and other bulky mail that normally could be placed into the receptacle will not fit through the slot. It is also time consuming for the mail carrier to have to deal with pushing mail through slots.

Objects and Advantages

None of the above references, however, discloses a locking mechanism of the type disclosed in our single-door security mailbox. Several objects and advantages in our present invention are:

a) It operates like a conventional mailbox in that there is a single door and a single compartment in which out-going and in-coming mail can be placed and removed.

b) It can be incorporated into a conventional mail box design c) It will provide a safe and secure depository for mail.

d) It is of a simple mechanical design that can be manufactured much more economically than the previously described prior art of U.S. Pat. No. 3,758,027 to Morgan and U.S. Pat. No. 4,382,540 to Kelly and others similar to it.

DRAWING FIGURES

In the drawings, closely related figures have the same number but different alphabetic suffixes.

REFERENCE NUMERALS IN DRAWINGS

Figure 1:
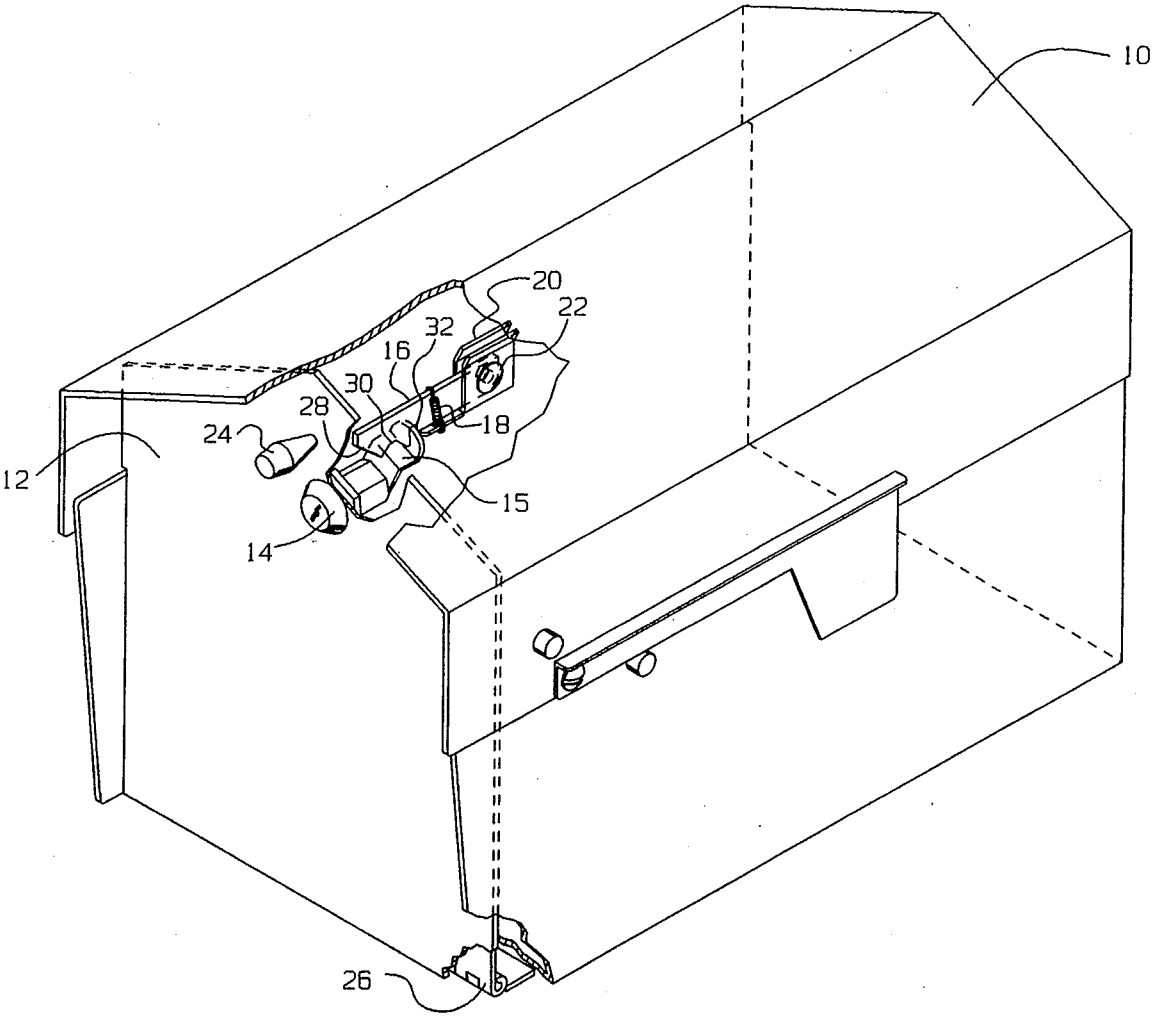
FIG. 1 is an isometric view that shows the present invention embodied in a rural mailbox.

10 housing
12 closure
14 conventional cabinet lock
15 latching member
16 catching
18 spring
20 u-shaped bracket, supporting
22 rivet
24 knob
26 hinge
28 entry notch
30 retaining indent 32 locking indent
34 alternate embodiment of entry notch
36 alternate embodiment of retaining indent

DESCRIPTION OF THE PREFERRED EMBODIMENT

For the purposes of promoting an understanding of the principles of our single-door locking mailbox, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
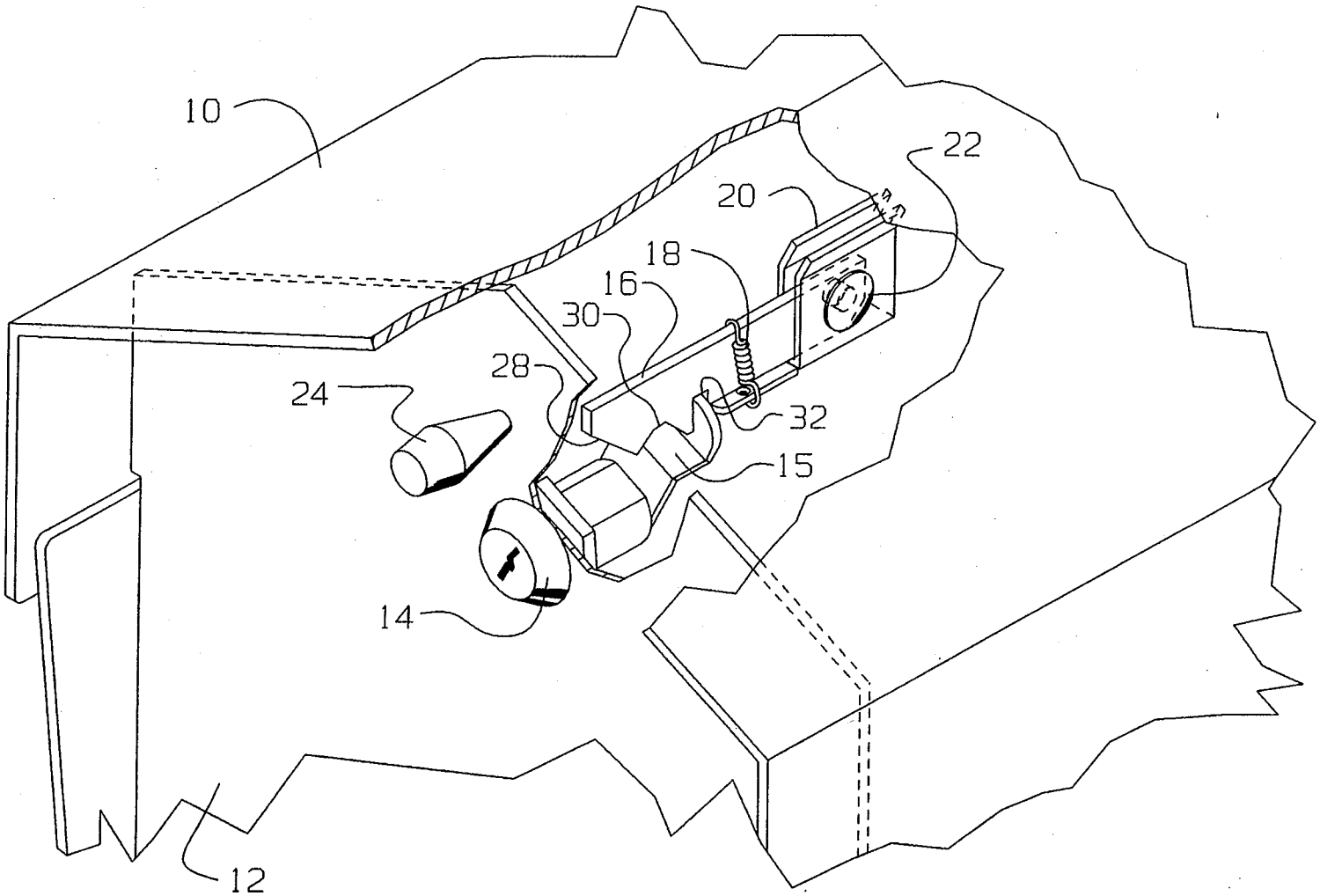
FIG. 2 is a close-up isometric view of the present invention.

Referring now to the drawings, a perspective view of a single-door security rural mailbox is generally designated in FIG. 1 and comprises of a housing 10 having a flat bottom, with a closure 12 being the front of housing 10 and is pivotally mounted to the bottom of housing 10. Closure 12 is hinged horizontally at bottom of housing 10 with hinge 26 so that closure 12 pivots outward from housing 10. Secured to an upper area of closure 12 is a conventional knob 24 and a conventional cabinet lock 14. A latching member 15 is secured to the end of conventional cabinet lock 14. A u-shaped bracket 20 with its bottom extending towards the front is secured to housing 10. A catching member 16 is secured to u-shaped bracket 20 by a rivet 22 passing through catching member 16 enabling catching member 16 to pivot in an upward direction. Downward movement of catching member 16 is limited by base of u-shaped bracket 20. Latching member 15 is alined with catching member 16 when latching member 15 is in its locked position as illustrated by the front view of FIG. 3. Referring to close up view FIG. 2 a spring 18 connected to base of u-shaped bracket 20 and top of catching member 16 urges catching member 16 towards the base of u-shaped bracket 20 for the purpose of urging connectivity of latching member 15 with catching member 16. On bottom front edge of catching member 16 is a entry notch 28. Also on bottom of catching member 16 are two indents in which retaining indent 30 is used for securing closure 12 in an upright position and a locking indent 32 is used for locking closure 12. Retaining indent 30 comprises of outward camming sides and locking indent 32 comprises of straight sides that are somewhat perpendicular to bottom of catching member 16.

Figure 3:
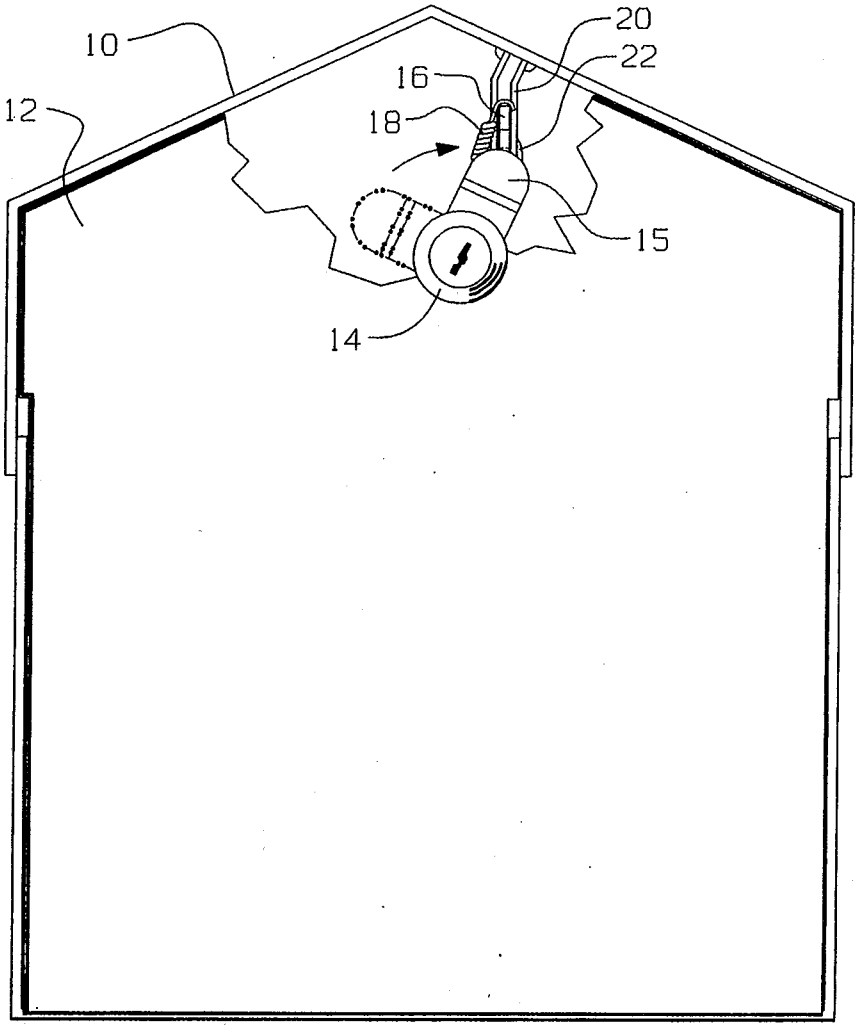
FIG. 3 shows a front view of the invention with lock rotated to locked position prior to set position.
Figure 4A:
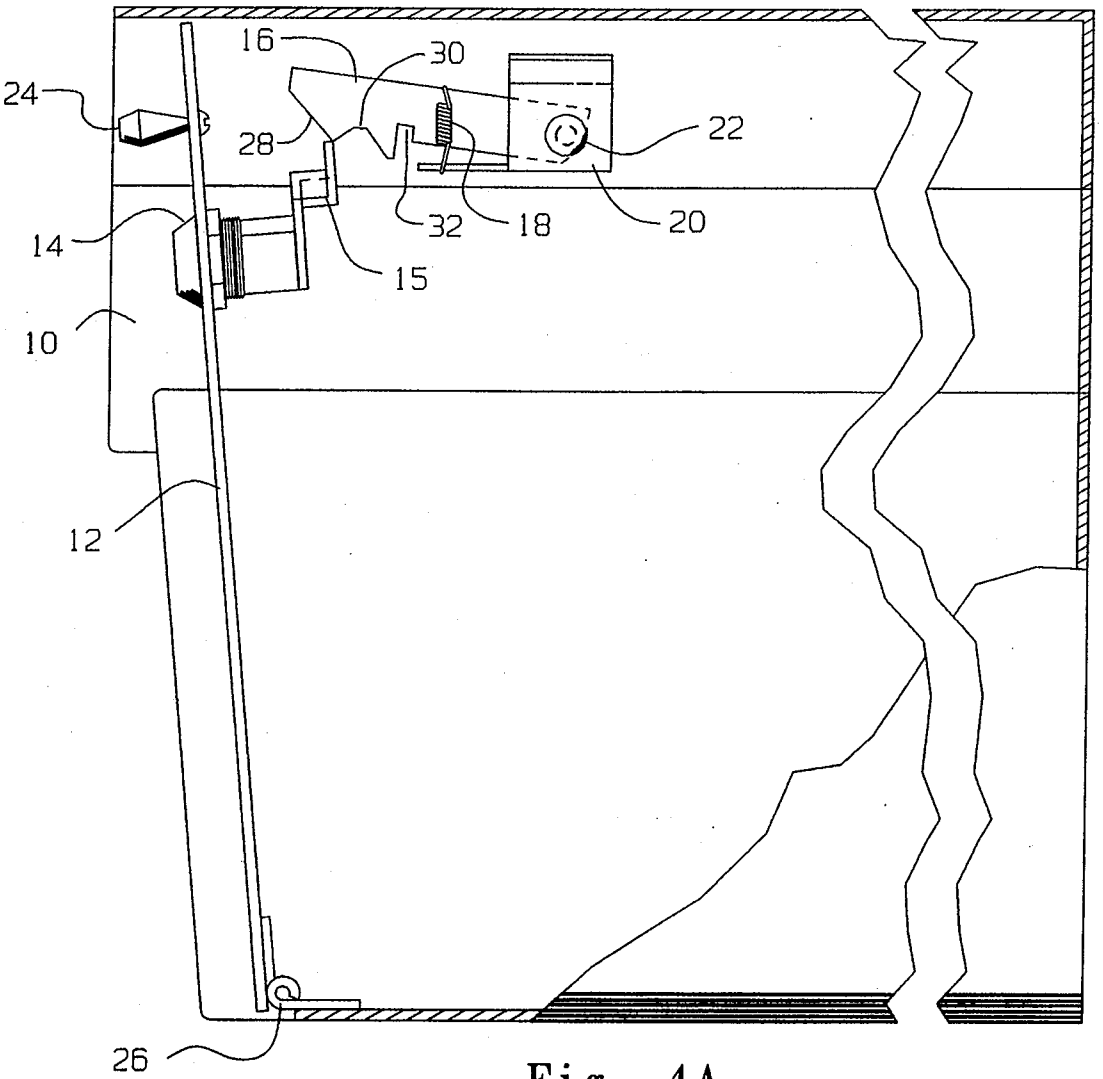
FIG. 4A shows a side view with lock, in locked position, just before it engages catch member, this being the entry position.
Figure 4B:
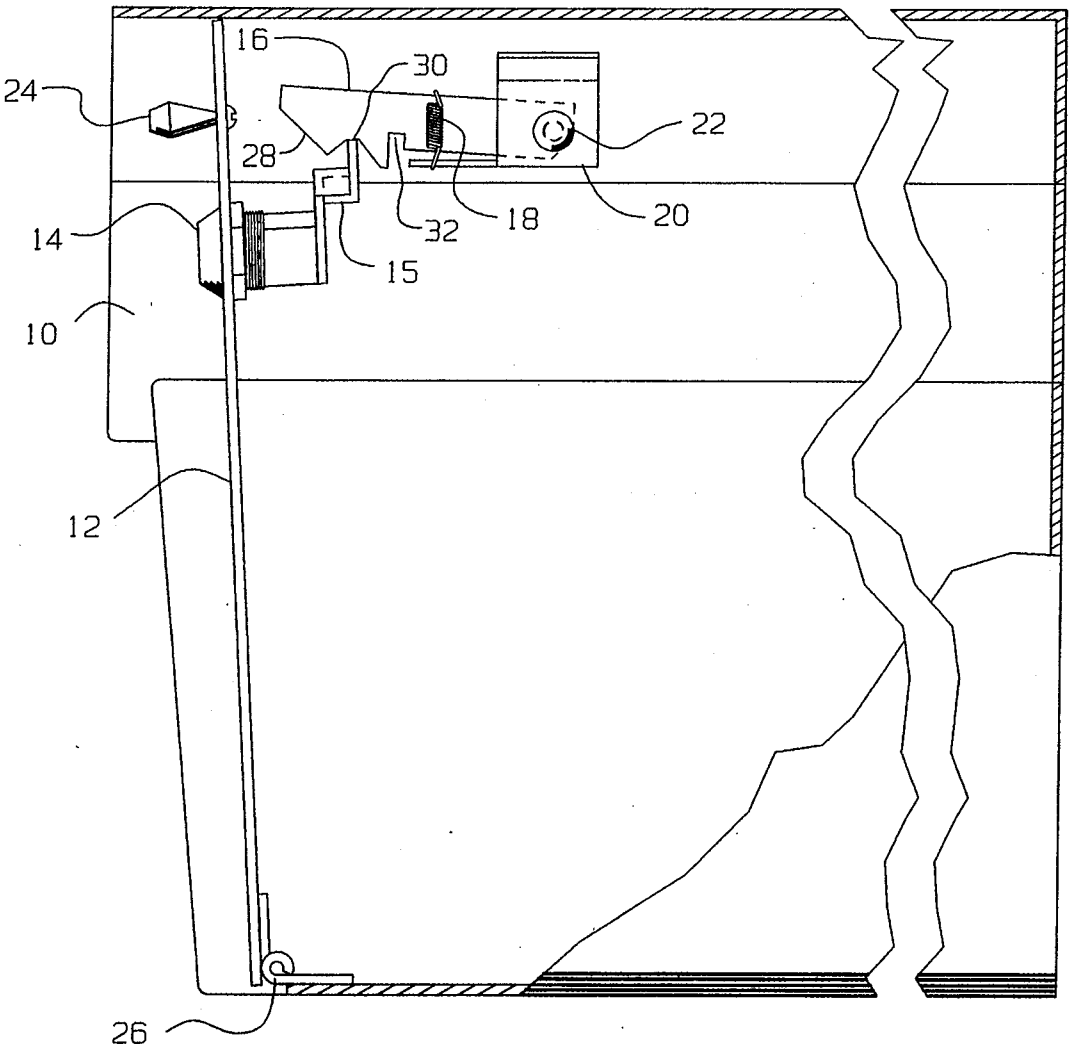
FIG. 4B shows a side view with lock, in locked position, engaged in set position with catch member.
Figure 4C:
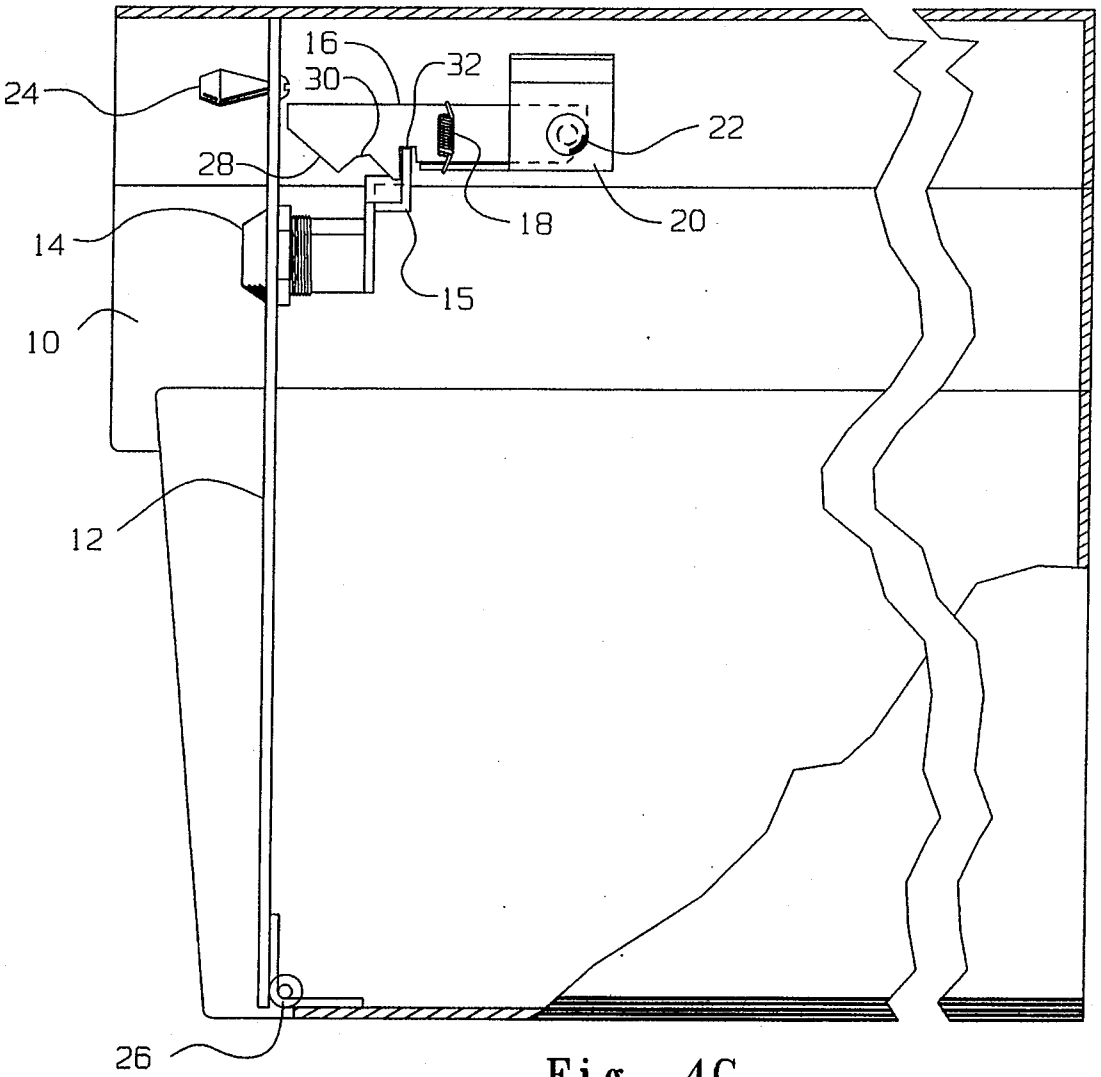
FIG. 4C shows a side view with lock, in locked position, engaged in locked position with catch member.
Figure 5:
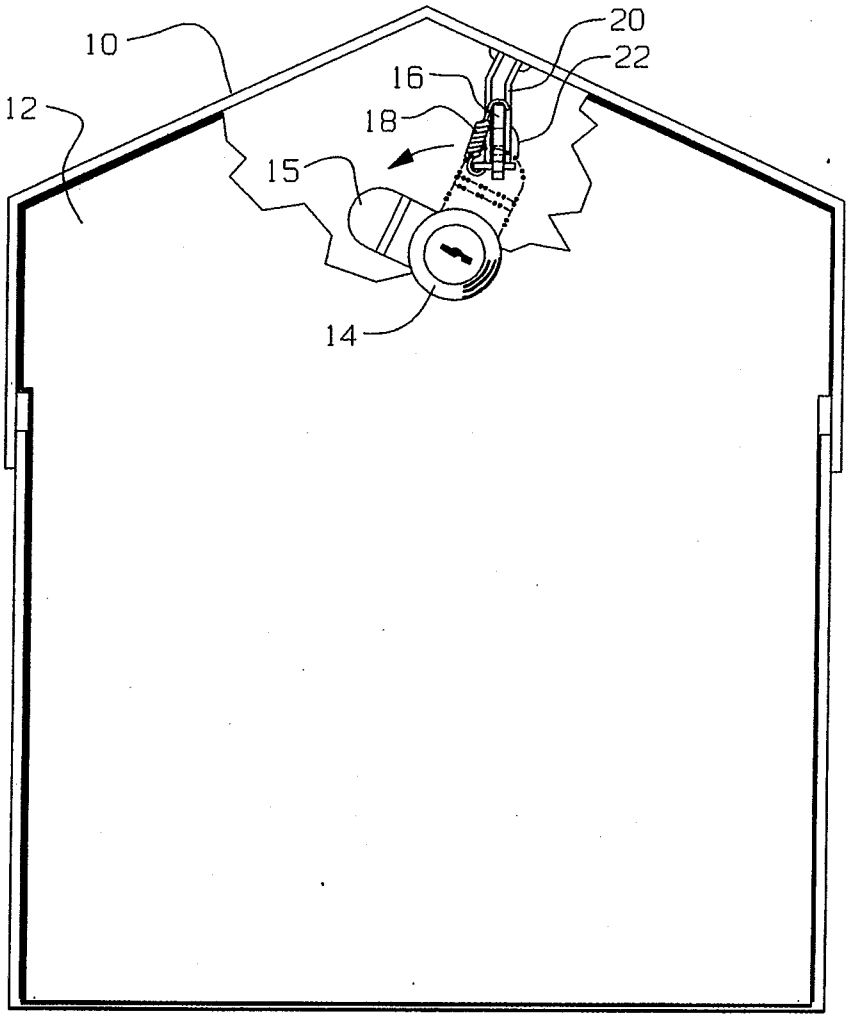
FIG. 5 shows a front view with lock rotated to unlocked position to enable disengagement from catch.

Now refer to FIGS. 3 through 5 for a description of the operation of our single-door security mailbox. Retained by the owner of the mailbox, a conventional key (not shown) is inserted into conventional cabinet lock 14 allowing the owner of the mailbox to set latching member 15 by rotating it to the locked position as illustrated in FIG. 3. When closure 12 is moved towards housing 10 as illustrated by FIG. 4A, latching member 15 engages with entry notch 28 on catching member 16 and then urges catching member 16 in an upward direction while spring 18 urges connectivity of catching member 16 with latching member 15. As Illustrated in FIG. 4B the inward movement of closure 12 continues until the owner of the mailbox stops it at retaining indent 30 on catching member 16, therefore closure 12 is secured in an upright set position awaiting to be opened by the mail carrier for removing out-going mail and then placing in-coming mail into housing 10. Mail carrier opens closure 12 by pulling on knob 24. Mail carrier will then close closure 12 with sufficient force so that latching member 15 proceeds past retaining indent 30 on catching member 16 and then engages with locking indent 32 as illustrated in FIG. 4C, therefore locking and securing the contents within housing 10. The owner of the mailbox will then insert key into conventional cabinet lock 14 enabling latching member 15 to rotate away from and disengage with locking indent 32 on catching member 16 as illustrated in FIG. 5, therefore permitting closure 12 to unlock and open away from housing 10 by pulling on knob 24. Only authorized persons having a key to conventional cabinet lock 14 may remove in-coming contents from mailbox as shown in FIG. 1.

Figure 6:
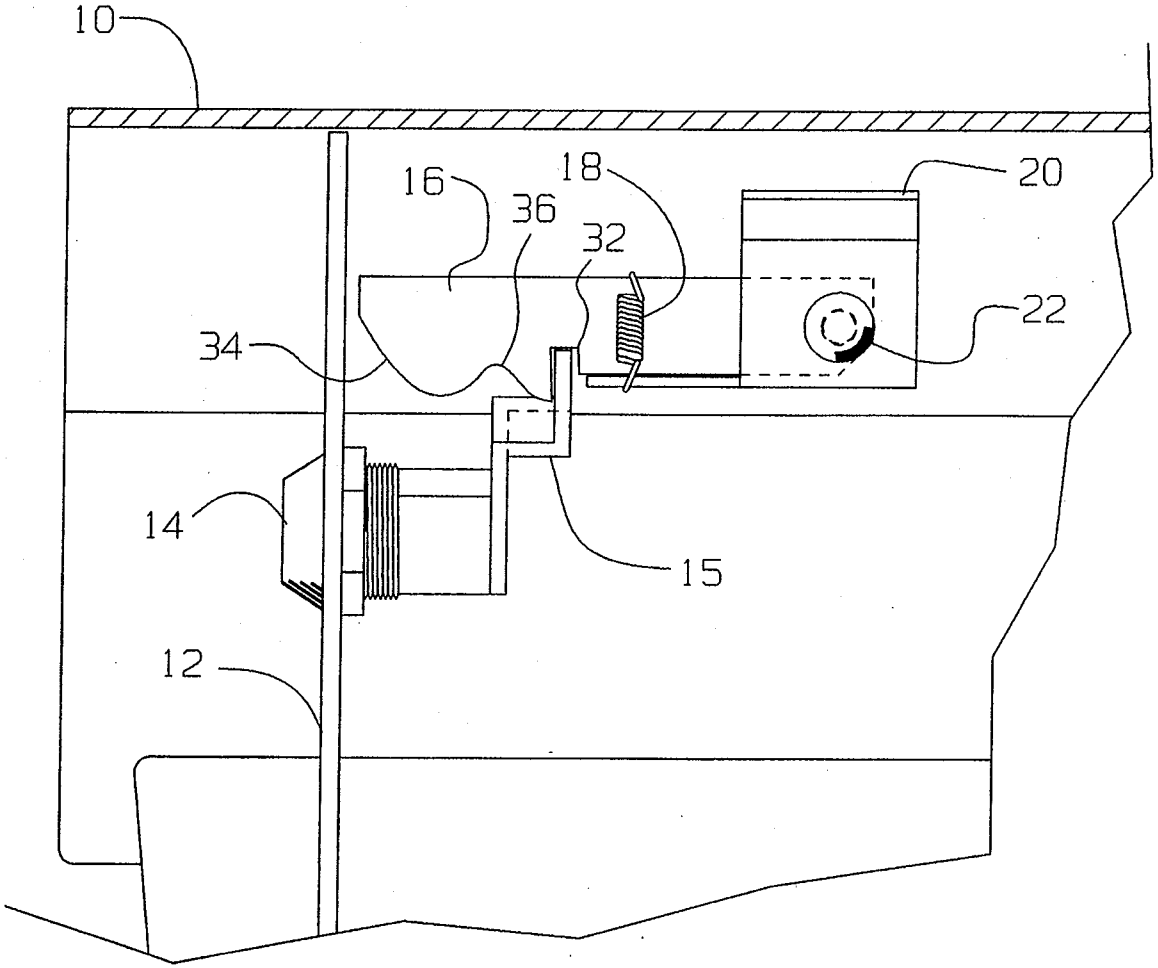
FIG. 6 shows a side view of an alternate embodiment of catch member, providing same function.

FIG. 6 shows a second preferred embodiment of catching member 16 providing the same function as previously stated. A tapered curve 34 is used for entry engagement of latching member 15. Retaining indent 36 comprises of outwardly tapered curved sides for engagement of latching member 15 into set position for closure 12.

Summary, Ramifications, and Scope

Accordingly, the reader will see that the single-door locking mailbox of this invention will provide a safe and secure depository for rural or residential curb-side customers while keeping the convenience of a traditional curb-side mailbox. In addition another advantage inherited by the not obvious but simple design of this invention is that it can economically be manufactured.

Although the description of this invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the catching member indents and lead in notch can have other shapes and curves that will provide the same function as that described in the drawings.

Thus the scope of the invention should be determined by the appended claims and their legal equivalents, rather than by the examples given.

We claim:

1. A secure locking depository receptacle comprising:

(a) a housing having an inside, an outside and an end, said housing being open at said end;

(b) a closure movably mounted at said end for closing said end, said closure having an inner and an outer surface;

(c) a lock mounted to said closure having a latching member attached to said lock, said latching member mounted substantially parallel to the inner surface of said closure, said lock and said latching member having a locked position and an unlocked position;

(d) a catching member pivotally attached to said inside of said housing, whereby said catching member has limited movement, whereby said latching member in said locked position will engage with said catching member, said catching member including a means for urging connectivity of said catching member and said latching member upon closing of said closure; said catching member comprising an entry notch, a retaining indent comprising outward camming sides and a locking indent, whereby when said entry notch is engaged by said latching member said latching member will be guided into said retaining indent; said retaining indent is for holding said closure in a closed and unlocked position while said latching member is in a locked position, thereby allowing said closure to be subsequently opened and then closed; upon sufficient closing force of said closure, said latching member will proceed past said retaining indent and engage said locking indent holding said closure in a locked position while said latching member is in a locked position, whereby to open said closure one must unlock said lock disengaging said latching member from said locking indent.

* * * * *